United States Patent [19]

Ladenberger et al.

[11] 4,073,738

[45] Feb. 14, 1978

[54] LUBRICATING OIL COMPOSITIONS CONTAINING ALKYL ACRYLATE OR METHACRYLATE POLYMERS AND COPOLYMERS OF STYRENE AND CONJUGATED DIENE

[75] Inventors: Volker Ladenberger, Schwetzingen; Klaus Bronstert, Carlsberg; Friedrich Hovemann, Hockenheim; Petr Simak, Mannheim, all of Germany

[73] Assignee: BASF Aktiengesellschaft, Ludwigshafen (Rhine), Germany

[21] Appl. No.: 758,435

[22] Filed: Jan. 11, 1977

[30] Foreign Application Priority Data

Jan. 28, 1976 Germany ..... 2603034

[51] Int. Cl.[2] ..... C10M 1/28; C10M 1/18

[52] U.S. Cl. ..... 252/56 R; 252/59

[58] Field of Search ..... 252/56 R, 59

[56] References Cited

U.S. PATENT DOCUMENTS

| | | | |
|---|---|---|---|
| 3,312,621 | 4/1967 | Brownawell et al. | 252/59 |
| 3,600,311 | 8/1971 | Naiman et al. | 252/59 |
| 3,772,169 | 11/1973 | Small et al. | 252/59 |
| 3,948,843 | 4/1976 | Saint-Pierre et al. | 252/59 |
| 3,959,161 | 5/1976 | Dawans et al. | 252/59 |
| 4,031,020 | 6/1977 | Sugiura | 252/56 R |

*Primary Examiner*—Delbert E. Gantz
*Assistant Examiner*—J. Thierstein
*Attorney, Agent, or Firm*—Keil, Thompson & Shurtleff

[57] ABSTRACT

Mineral lubricating oil compositions which contain a predominant proportion of a mineral lubricating oil together with a pour point depressant based on alkyl acrylate or alkyl methacrylate polymers and a viscosity index (VI) improver comprising a special selectively hydrogenated copolymer of styrene and a conjugated diene. The VI improver employed is a selectively hydrogenated, random butadiene-styrene copolymer containing from 35 to 45% by weight of styrene and possessing a particular structure and distribution of the monomers. The compositions exhibit high stability to shear and may therefore in particular be used for lubricating I.C. engines or gearboxes.

2 Claims, No Drawings

LUBRICATING OIL COMPOSITIONS CONTAINING ALKYL ACRYLATE OR METHACRYLATE POLYMERS AND COPOLYMERS OF STYRENE AND CONJUGATED DIENE

The present invention relates to mineral oil lubricating compositions having an improved viscosity index (VI) which, in addition to a predominant proportion of mineral lubricating oil, contain a selectively hydrogenated butadiene-styrene copolymer with random distribution of the monomer units, and a pour point depressant based on alkyl acrylate or alkyl methacrylate polymers.

The temperature dependence of the viscosity of mineral lubricating oils is known and can be expressed in terms of the viscosity index. The viscosity index of the mineral lubricating oils can be improved by incorporation of certain additives. The use of hydrogenated copolymers synthesized from vinyl-aromatic compounds and conjugated diolefins, and containing the comonomers as randomly distributed copolymerized units or as blocks of copolymerized units, as additives for mineral lubricating oils has proved particularly appropriate and is described, for example, in German laid-open applications Nos. 1,811,516, 2,060,864, 2,060,914 and 2,132,336. These additives not only increase the viscosity and improve the viscosity index of the mineral lubricating oils, but in addition possess good shear stability.

In general, selectively hydrogenated, random copolymers of butadiene and styrene offer advantages, as additives for mineral lubricating oils, over comparable butadiene-styrene block copolymers, since the former possess superior viscosity-improving properties, coupled with good stability to shear forces; furthermore, the block copolymers are less soluble in mineral oil. Hydrogenated random butadiene-styrene copolymers which comprise a predominant proportion, ie. more than 50% by weight, of styrene as copolymerized units (cf. German laid-open application No. 1,811,516) suffer from the same disadvantage as butadiene-styrene block copolymers inasmuch as their solubility in mineral lubricating oils is low. For this reason, German laid-open application No. 2,210,430 proposes the addition of oil-soluble polymers of alkyl esters of α-olefinically unsaturated carboxylic acids to mineral lubricating oil compositions which contain hydrogenated random butadiene-styrene copolymers, with a predominant proportion of styrene, as VI improvers, in order to increase the solubility of the said copolymers. However, the solubility of these polymer mixtures in mineral oil is far from satisfactory, so that in general the hydrogenated, random butadiene-styrene copolymers containing a predominant proportion of butadiene as copolymerized units are preferred, as VI improvers, to the copolymers containing a predominant proportion of styrene as copolymerized units.

However, experience has shown that the hydrogenated, random butadiene-styrene copolymers in general do not respond to the conventional pour point depressants which as a rule are added to mineral lubricating oils, and that the effects of these pour point depressants are blocked by the conventional hydrogenated, random butadiene-styrene copolymers as well as by the conventional hydrogenated styrene-butadiene block copolymers. For this reason, U.S. Pat. No. 3,772,196 proposes the addition of a quite specific, selectively hydrogenated two-block copolymer of styrene and isoprene to mineral lubricating oils which contain a pour point depressant. It is true that these isoprene-styrene block copolymers prevent blocking of the pour point depressant, but they have the disadvantage that they are more expensive, and therefore less economical, than the preferred hydrogenated random butadiene-styrene copolymers, and that they are also less soluble in mineral oil than the said random copolymers.

It is an object of the present invention to provide an improved mineral lubricating oil composition which contains viscosity-improving additives which, even in relatively small amounts, produce a substantial increase in the viscosity index and exhibit good shear stability, and which at the same time are adequately soluble in the mineral lubricating oils and produce no significant reduction, if any, in the effect of conventional pour point depressants.

We have found, surprisingly, that this object is achieved by adding to the mineral lubricating oil a viscosity index improver which is a selectively hydrogenated, random butadiene-styrene copolymer, containing a predominant proportion of butadiene and a minor proportion of styrene as copolymerized units, and having a quite specific structure and random distribution of the monomers.

Accordingly, the present invention relates to mineral lubricating oil compositions which contain a. a predominant proportion of the mineral lubricating oil, b. from 0.05 to 2.5% by weight, based on the mineral lubricating oil, of a pour point depressant based on alkyl acrylate or alkyl methacrylate polymers and c. from 0.5 to 6% by weight, based on the mineral lubricating oil, of a selectively hydrogenated, random butadiene-styrene copolymer comprising from 35 to 45% by weight of styrene units and from 65 to 55% by weight of hydrogenated butadiene units, which copolymer, prior to hydrogenation, had a 1,2-vinyl content of the polymerized butadiene units of from 23 to 40% by weight, based on copolymerized butadiene units, and which has a $^{13}$C-NMR spectrum in which the ratio of the sum of the intensities of the signals of the $CH_2$ groups in the β-position and the $CH_2$ groups of the ethyl branches $\Sigma CH_2$ (β + ethyl) to the sum of the intensities of the signals of the γ-$CH_2$ and δ-$CH_2$ carbon atoms and $CH_2$ carbon atoms more remote from the branch points, $\Sigma CH_2$ (γ, δ and more remote) is from 1:1 to 1:1.4, and has an IR spectrum in which the ratio of the extinctions E of the styrene bands at 1,180 $cm^{-1}$ and 1,150 $cm^{-1}$E (1,180)/ E(1,150) is from 0.6 to 0.73 and the ratio of the extinctions E of the styrene bands at 1,190 $cm^{-1}$ and 1,180 $cm^{-1}$ E(1,190)/E(1,180) is from 0.15 to 0.22, and in which the content of olefinic double bonds has been reduced to a residual proportion of less than 5% as a result of the selective hydrogenation.

The base oils employed for the compositions according to the invention are mineral lubricating oils which are obtained from naturally occurring crude mineral oils by conventional processes, eg. distillation and/or extraction and subsequent refining. The mineral lubricating oils may be of the paraffinic, naphthenic or aromatic type. Mixtures of different mineral lubricating oils may also be used. The mineral lubricating oils are characterized by their viscosity expressed in ° E at 50° C, which should preferably be from 1 to 20.

The VI improvers added to the mineral lubricating oils are selectively hydrogenated, random butadiene-styrene copolymers. The proportion of styrene units in the copolymer should be from 35 to 45% by weight, based on the copolymer. Accordingly, the proportion of hydrogenated butadiene units in the copolymer should be from 65 to 55% by weight, Before hydrogenation, the random butadiene-styrene copolymers intended for selective hydrogenation should have a 1,2-vinyl content of the polymerized butadiene units of from 23 to 40% by weight, preferably from 25 to 35% by weight, based on copolymerized butadiene units. In general, the 1,2-vinyl content of the polymerized butadiene units should be as low as possible, since hydrogenated random butadiene-styrene copolymers which have a high 1,2-vinyl content before hydrogenation are relatively prone to oxidation. For this reason, a 1,2-vinyl content of polymerized butadiene units greater than about 40% by weight is disadvantageous. On the other hand, we have found that the 1,2-vinyl content of the polymerized butadiene units must not fall below the stated lower limit, since otherwise the selectively hydrogenated random butadiene-styrene copolymers block the pour point depressants, ie. the pour point of the mineral lubricating oil can no longer be influenced by adding such a depressant. The lower permissible limit of 1,2-vinyl content of the polymerized butadiene units in the copolymer is also affected by the ratio of comonomers in the copolymer and may therefore be displaced to somewhat higher values in the case of certain copolymers. The general rule is that as the proportion of butadiene in the copolymer increases, the lower limit of the 1,2-vinyl content of the polymerized butadiene units increases somewhat.

Further, it has proved essential that the selectively hydrogenated butadiene-styrene copolymers to be employed, according to the invention, as VI improvers should have a quite specific random distribution of the comonomers. The random distribution can be deduced from the IR spectrum and $^{13}$C-NMR spectrum of the selectively hydrogenated copolymer.

In order to assess quantitatively the degree of randomness of the selectively hydrogenated butadiene-styrene copolymers, the ratio of the sum of the intensities of the signals of the $CH_2$ groups in the $\beta$-position and of the $CH_2$ groups of the ethyl branches to the total intensity of the $\gamma$-$CH_2$ and $\delta$-$CH_2$ carbon atoms and $CH_2$ carbon atoms more remote from the branch points, in the $^{13}$C-NMR spectrum, is determined. The terms $\beta$-, $\gamma$- and $\delta$-$CH_2$ group relate to the position of the carbon atoms in the polymer backbone relative to the side chains or side groups (phenyl groups of styrene and ethyl branches resulting from 1,2-vinyl structure of the butadiene units). The signals of the $CH_2$ groups in the $\beta$-position and the $CH_2$ groups of the ethyl branches are to be found in the region of from 25.5 to 28 ppm and those of the $\gamma$- and $\delta$-$CH_2$ groups and $CH_2$ groups more remote from the branch points, in the region of from 29 to 31 ppm, measured in chloroform at room temperature and related to tetramethylsilane as the standard. In the case of the selectively hydrogenated, random butadiene-styrene copolymers to be employed according to the invention, this ratio of the intensities $$\frac{\Sigma\ CH_2\ (\beta + \text{ethyl})}{\Sigma\ CH_2\ (\gamma,\ \delta \text{ and more remote})} = \text{from 1:1 to 1:1.4}$$

By contrast, copolymers in which this intensity ratio gives, depending on the styrene content of the polymers, values of from 1:1.5 to 1:2, are unsuitable because they have a blocking action on the pour point depressant.

For the IR-spectroscopic determination of the degree of randomness in the selectively hydrogenated butadiene-styrene copolymers, IR spectra of films of the copolymers deposited from carbon disulfide solution on potassium bromide tablets are recorded. The intensity (extinction) of the styrene bands at about 1,190 $cm^{-1}$, 1,180 $cm^{-1}$ and 1,150 $cm^{-1}$ is measured by the baseline process. In the selectively hydrogenated butadiene-styrene copolymers to be employed according to the invention, the ratio of the extinctions E of the bands at 1,180 $cm^{-1}$ and 1,150 $cm^{-1}$ E(1,180)/E(1,150) should be from 0.6 to 0.73 and the ratio of the extinctions E of the bands at 1,190 $cm^{-1}$ and 1,180 $cm^{-1}$ E(1,190)/E(1,180) should be from 0.15 to 0.22. Copolymers which give higher values of these ratios are unsuitable for use according to the invention, since they block the pour point depressant. The measurement and evaluation of the IR and $^{13}$C-NMR spectra have in other respects been described and are carried out by conventional methods, so that further details may be found in the relevant specialist literature.

The copolymers to be employed as VI improvers according to the invention can be manufactured in the conventional manner by anionic solution polymerization of a mixture of the monomers, using alkali metal-organic compounds as initiators, followed by selective hydrogenation of the random copolymers obtained. Preferred initiators for the polymerization are the conventional lithium-hydrocarbons, amongst which lithium-alkyls, where alkyl is of 2 to 6 carbon atoms, are particularly suitable. Examples of lithium-hydrocarbon initiators are ethyl-lithium, propyl-lithium, isopropyl-lithium, cyclohexyl-lithium, phenyl-lithium, p-tolyl-lithium and especially n- and sec.-butyl-lithium. Solvents used for the polymerization are, in general, inert organic hydrocarbon solvents, e.g., aliphatic, cycloaliphatic or aromatic hydrocarbons which are liquid under the reaction conditions and preferably contain from 4 to 12 carbon atoms. Examples of suitable solvents are pentane, hexane, cyclohexane, methylcyclohexane, benzene, toluene, the xylenes and the like. Mixtures of these solvents may also be employed. In many cases it has proved advantageous to carry out the polymerization of the monomer mixture of butadiene and styrene directly in the mineral lubricating oil as the solvent. The polymerization is carried out in the presence of small amounts of polar substances, preferably polar solvents, which do not inactivate the initiator. Examples of such polar substances are tertiary amines, alcoholates and, in particular, linear or cyclic ethers, e.g., diethyl ether, dimethoxyethane, phenyl methyl ether and especially tetrahydrofuran. The polar substances are in general employed in amounts of from 0.01 to 10% by weight, preferably of from 0.1 to 2% by weight, based on the total solvent. The polymerization temperature should be relatively low. In isothermal polymerization, the temperature should not exceed +75° C and is preferably kept at from +30° C to +70° C; if the polymerization temperature is raised continuously during the polymerization, the final temperature should not exceed about 110° C. In other respects, the polymerization of the monomer mixture of butadiene and styrene is carried out under the conventional conditions for anionic polymerization, e.g., in an inert gas atmosphere, with exclusion of oxygen and moisture. The details of the polymerization conditions are selected, in the manner known to those skilled in the art, to give copolymers which have the desired 1,2-vinyl content and degree of randon distribution.

Following the polymerization, and advantageously before isolating the reaction product from the reaction solution, the olefinic double bonds of the random butadiene-styrene copolymers obtained are hydrogenated selectively. The selective hydrogenation can also be carried out by the conventional method, using molecular hydrogen and catalysts based on metals or metal salts of group 8 of the periodic table, as described, for example, in U.S. Pat. No. 3,113,986, German published application DAS No. 1,222,260 or German laid-open application DOS No. 2,013,263. According to these publications, the selective hydrogenation of the olefinic double bonds is preferably carried out in a homogeneous phase, using catalysts based on salts, especially carboxylates, enolates or alkoxides, of nickel, cobalt or iron, which have been reduced with metal-alkyls, especially aluminum-alkyls, at hydrogen pressures of from 1 to 100 bars and at from 25° to 150° C. The selective hydrogenation is taken to the point that the content of olefinic double bonds in the random butadiene-styrene copolymers has been reduced to a residual proportion of less than 5%, preferably less than 2%. The residual proportion of olefinic double bonds in the polymer is determined by a Wijs titration or by IR-spectroscopic analysis. In particular, the hydrogenation is continued until the olefinic double bonds have been virtually completely reduced. Preferably, the hydrogenation is carried out under conditions such that the aromatic double bonds of the random butadiene-styrene copolymer are not attacked. The selectively hydrogenated random butadiene-styrene copolymer are not attacked. The selectively hydrogenated random butadiene-styrene copolymers to be employed according to the invention in general have a molecular weight of from 30,000 to 150,000 and preferably from 50,000 to 100,000. These data relate to the number-average molecular weight, determined from osmotic pressure measurements.

The selectively hydrogenated copolymers are isolated from the reaction solution by conventional methods, e.g., by evaporating off the solvent or, advantageously, by precipitating the polymer from the reaction solution by means of protonic compounds, e.g., alcohols, and filtering off and drying the product. If the polymerization has been carried out directly in the mineral lubricating oil as the solvent, the selectively hydrogenated random butadiene-styrene copolymer of course does not have to be isolated; instead, the initiator is simply deactivated by adding small amounts of protonic compounds and the solution of the selectively hydrogenated copolymers in the mineral lubricating oil is diluted, if necessary, to the desired concentration by adding further mineral lubricating oil. Where the polymerization has not been carried out in the mineral lubricating oil, the isolated copolymers are dissolved in the oil, preferably at from about 80° to 120° C. The proportion of selectively hydrogenated random butadiene-styrene copolymers in the mineral lubricating oil should be from 0.5 to 6% by weight, preferably from 1 to 5% by weight, based on the mineral lubricating oil.

The pour point depressants which are added, according to the present invention, to the mineral lubricating oil compositions are used in small but effective amounts. They are intended to lower the pour point of the mineral lubricating oil compositions, preferably to below −30° C. The proportion of the pour point depressant in the mineral lubricating oil composition is in general from 0.05 to 2.5% by weight, preferably from 0.1 to 1% by weight, based on the mineral lubricating oil. According to the present invention, the pour point depressants used are the conventional commercial alkyl acrylate or alkyl methacrylate polymers and copolymers. These are derived from alkyl acrylates or alkyl methacrylates with long-chain alkyl groups as the alcohol component. The alkyl acrylates and alkyl methacrylates in general have alkyl groups of 8 to 30 carbon atoms, preferably of 8 to 22 carbon atoms. The alkyl groups of the esters may have straight or branched chains, though in general acrylates or methacrylates derived from straight-chain alkyl alcohols are preferred. In the case of the alkyl acrylate polymers, those derived from acrylates in which the alkyl group is of 16 to 22 carbon atoms are employed preferentially. In the case of the alkyl methacrylate polymers preferentially employed, the alkyl groups of the methacrylate units are in particular of 12 to 16 carbon atoms. Whilst homopolymers of the alkyl acrylates or alkyl methacrylates can be employed as pour point depressants, it can also be of advantage to use copolymers derived from a mixture of the said alkyl acrylates and/or alkyl methacrylates, in which mixtures the esters have alkyl chains of varying lengths. Further suitable pour point depressants are copolymers of the alkyl acrylates or alkyl methacrylates in question, which contain a minor proportion, i.e., in general less than 50% by weight and preferably less than 30% by weight, of other copolymerizable monomers, e.g., alkyl acrylates or alkyl methacrylates in which the alkyl group is of 1 to 7 carbon atoms, e.g., methyl methacrylate, vinyl esters, e.g., vinyl acetate, or nitrogen-containing monomers, e.g., N-vinylpyrrolidone, vinylpyridine and others, as copolymerized units.

In addition to the selectively hydrogenated random butadiene-styrene copolymers and pour point depressants, to be employed according to the invention, the mineral lubricating oil compositions may contain other conventional additives and adjuvants, as used conventionally for the manufacture of compounded mineral lubricating oils. These further additives may be, for example, antioxidants, e.g., sterically hindered phenols, dyes, detergents and dispersing agents, e.g., alkaline earth metal petroleum-sulfonates, alkylsuccinimides or alkyl salicylates, extreme pressure additives, e.g., zinc dialkyldithiophosphate, or anti-foam agents, e.g., silicone polymers. The mineral lubricating oil compositions of the invention have a high viscosity index and exhibit good stability to shear without the addition of the VI improver affecting and impairing the action of the added pour point depressant. The mineral lubricating oil compositions are used for lubricating metal surfaces which undergo relative motion, especially in I.C. engines and gearboxes.

In the Examples, parts and percentages are by weight, unless stated otherwise.

EXAMPLE 1

500 ml of butadiene and 270 ml of styrene are polymerized in 2,700 ml of mineral oil (viscosity 2.3° E/50° C) in the presence of 6.0 ml of tetrahydrofuran at 50° C, by means of 10 ml of a 5% strength solution of n-butyllithium in hexane. The polymerization time is 3.5 hours. A random butadiene-styrene copolymer is formed, which according to the IR spectrum contains 40% of styrene and has a 1,2-vinyl content of the butadiene units of 27%, based on copolymerized butadiene. The number-average molecular weight, determined in toluene at 37° C by means of a membrane osmometer, is about 75,000. 20 ml of a homogeneous catalyst solution, comprising 0.3 g of nickel-II acetylacetonate, 10 ml of a 20% strength aluminum-triisobutyl solution in hexane and 10 ml of toluene, are then added to the polymer solution. Hydrogenation is carried out under a pressure of 10 bars of hydrogen at 75° C. After the hydrogenation, the proportion of olefinic double bonds in the random butadiene-styrene copolymer was found to have been reduced to a residual proportion of about 0.5% (determined from the IR spectrum). The ratio of the extinction of the styrene bands in the IR spectrum (recorded by means of an IR-spectrophotometer from Perkin-Elmer, Model 521), i.e., E(1,180)/E(1,150) and E(1,190)/E(1,180), of the selectively hydrogenated random butadiene-styrene copolymer is respectively 0.72 and 0.18. In the $^{13}$C-NMR spectrum, the ratio $\Sigma CH_2$ ($\beta$ and ethyl)/$\Sigma CH_2$ ($\gamma$, $\delta$ and more remote) is 1:1.15.

140 g of the polymer solution in mineral oil, thus obtained, are diluted with a further 860 g of the mineral oil, of viscosity 2.3° E/50° C. The 2.85% strength solution of the selectively hydrogenated random butadiene-styrene copolymer in the mineral lubricating oil, thus obtained, has a viscosity index of 142 (measured according to DIN 51,564). The DIN 51,382 shear test produces a viscosity drop of 2%. The pour point of the solution is −17° C. After adding 0.4% of a 50% strength solution of polylauryl methacrylate in the same mineral lubricating oil, the final composition has a pour point of −40° C.

COMPARATIVE EXAMPLE A

The procedure of Example 1 is followed, except that in this case the polymerization is carried out in the presence of only 1.5 ml of tetrahydrofuran. The resulting butadiene-stryrene copolymer has, prior to hydrogenation, a 1,2-vinyl content of the copolymerized butadiene units of only 21%, based on polymerized butadiene. The extinction ratios [E(1,180)/E(1,150)] and [E(1,190)/E(1,180)] in the IR spectrum of the selectively hydrogenated polymer are respectively 0.8 and 0.29. The molecular weight, styrene content and residual proportion of olefinic double bonds in the selectively hydrogenated butadiene-styrene copolymer correspond to those described in Example 1. The pour point of a 2.85% strength solution of this selectively hydrogenated random butadiene-styrene copolymer in the mineral lubricating oil is, however, not lowered by adding polylauryl methacrylate as a pour point depressant.

COMPARATIVE EXAMPLE B

Example 1 is repeated, with the sole difference that the polymerization temperature is kept at 90° C. The resulting butadiene-styrene copolymer, prior to hydrogenation, has a 1,2-vinyl content of the copolymerized butadiene units of 22%, based on polymerized butadiene. In the IR spectrum of the selectively hydrogenated copolymer, the extinction ratios [E(1,180)/E(1,150)] and [E(1,190)/E(1,180)] are respectively 0.79 and 0.28. In the $^{13}$C-NMR spectrum, the intensity ratio $\Sigma CH_2$ ($\beta$ + ethyl)/$\Sigma CH_2$ ($\gamma$, $\delta$ and more remote) has a value of 1:1.79. The other data correspond to those described in Example 1. In this case, again, the pour point of a mineral lubricating oil which contains 2.85% of this selectively hydrogenated, random butadiene-styrene copolymer is not influenced by adding polylauryl methacrylate as a pour point depressant.

EXAMPLE 2

Example 1 is repeated, with the difference that this time the polymerization temperature is not kept constant but rises in the course of the polymerization. The polymerization is started at 25° C and the final temperature is 100° C. The butadiene-styrene copolymer obtained has, prior to hydrogenation, a 1,2-vinyl content of the polymerized butadiene units of 25%, based on the polymerized butadiene. The styrene content of the copolymer is 40% and the number-average molecular weight is about 75,000. After selective hydrogenation, the residual proportion of olefinic double bonds in the copolymer is less than 0.5%. The extinction ratio of the styrene bands [E(1,180)/E(1,150)] and [E(1,190)/E(1,180)] , in the IR spectrum of the selectively hydrogenated copolymer is, respectively, 0.67 and 0.17. In the $^{13}$C-NMR spectrum, the intensity ratio $\Sigma CH_2$ ($\beta$ + ethyl)/$\Sigma CH_2$ ($\gamma$, $\delta$ and more remote) is 1:1.2.

The resulting solution of the selectively hydrogenated random butadiene-styrene copolymer in the mineral lubricating oil is diluted to 2.85% by adding further mineral lubricating oil. This solution has a viscosity index of 142, and in the shear test the viscosity drops by 2%. The pour point of the mineral lubricating oil solution is −17° C and is lowered to −38° C by adding 0.4% of a 50% strength solution of polylauryl methacrylate in the mineral lubricating oil.

COMPARATIVE EXAMPLE C

Example 2 is modified by starting the polymerization at 25° C but using a final temperature of 125° C. In other respects the procedure described in Example 2 is followed. Whilst, before hydrogenation, the butadiene-styrene copolymer has a 1,2-vinyl content of the polymerized butadiene units of 26%, based on polymerized butadiene, the extinction ratio of the styrene bands [E(1,180)/E(1,150)] and [E(1,190)/E(1,180)] in the IR spectrum of the selectively hydrogenated copolymer is 0.75 and 0.31 respectively. The addition of the pour point depressant to a 2,85% strength solution of this selectively hydrogenated, random butadiene-styrene copolymer in the mineral lubricating oil has no effect.

We claim:

1. A mineral lubricating oil composition containing
   (a) a predominant proportion by weight of mineral lubricating oil,
   (b) from 0.05 to 2.5% by weight, based on the mineral lubricating oil, of a pour point depressant based on an alkyl acrylate or alkyl methacrylate polymer and
   (c) from 0.5 to 6% by weight, based on the mineral lubricating oil, of a selectively hydrogenated, random butadiene-styrene copolymer comprising from 35 to 45% by weight of styrene units and from 65 to 55% by weight of hydrogenated butadiene units, which copolymer, prior to hydrogenation, has a 1,2-vinyl content of the polymerized butadiene units of from 23 to 40% by weight, based on copolymerized butadiene units, and which has a $^{13}$C-NMR spectrum in which the ratio of the sum of the intensities of the signals of the $CH_2$ groups in the $\beta$-position and the $CH_2$ groups of the ethyl branches, $\Sigma CH_2$ ($\beta$ + ethyl), to the sum of the intensities of the signals of the $\gamma$-$CH_2$ and $\delta$-$CH_2$ carbon atoms and $CH_2$ carbon atoms more remote from the branch points, $\Sigma CH_2$ ($\gamma$, $\delta$ and more remote), is from 1:1 to 1:1.4, and has an IR spectrum in which the ratio of the extinctions, E, of the styrene bands at 1,180 $cm^{-1}$ and 1,150 $cm^{-1}$, E(1,180-)/E(1,150), is from 0.6 to 0.73 and the ratio of the extinctions, E, of the styrene bands at 1,190 $cm^{-1}$ and 1,180 $cm^{-1}$, E(1,190)/E(1,180), is from 0.15 to 0.22, and in which the content of olefinic double bonds has been reduced to a residual proportion of less than 5% as a result of the selective hydrogenation.

2. A mineral lubricating oil composition as claimed in claim 1, wherein the selectively hydrogenated random butadiene-styrene copolymer has a number-average molecular weight of from 30,000 to 150,000.

* * * * *